US005121910A

United States Patent [19]

Hajek et al.

[11] Patent Number: 5,121,910

[45] Date of Patent: Jun. 16, 1992

[54] SYSTEM FOR INTERLEAVING AND MIXING A PLURALITY OF WEBS, PARTICULARLY SLIT WEBS RECEIVED FROM A PRINTING MACHINE

[75] Inventors: Josef Hajek, Friedberg; Norbert Grimm, Augsburg, both of Fed. Rep. of Germany

[73] Assignee: MAN Roland Druckmaschinen AG, Offenbach am Main, Fed. Rep. of Germany

[21] Appl. No.: 644,612

[22] Filed: Jan. 23, 1991

[30] Foreign Application Priority Data

Feb. 8, 1990 [DE] Fed. Rep. of Germany ..... 4003706

[51] Int. Cl.[5] ..... B41F 13/64

[52] U.S. Cl. ..... 270/10; 270/52; 270/43; 270/18; 226/197; 226/199

[58] Field of Search ..... 270/1.1, 5, 10, 18, 270/19, 42, 43, 21.1, 20.1, 52; 226/199, 197

[56] References Cited

U.S. PATENT DOCUMENTS

| | | | |
|---|---|---|---|
| 2,920,887 | 1/1960 | Keightley | 270/5 |
| 3,433,136 | 3/1969 | Hartbauer | 270/52 |
| 3,623,645 | 11/1971 | Klingler | 226/199 |
| 3,734,487 | 5/1973 | Treff | 270/10 |
| 3,809,303 | 5/1974 | Brunner | 226/197 |
| 4,154,386 | 5/1979 | Kawadà | 270/18 |

FOREIGN PATENT DOCUMENTS

| | | | |
|---|---|---|---|
| 2020139 | 11/1970 | Fed. Rep. of Germany . | |
| 2920684 | 11/1980 | Fed. Rep. of Germany . | |
| 2920701 | 4/1981 | Fed. Rep. of Germany . | |
| 3501389 | 7/1986 | Fed. Rep. of Germany . | |
| 656009 | 8/1951 | United Kingdom | 226/197 |

*Primary Examiner*—Edward K. Look
*Assistant Examiner*—Therese M. Newholm
*Attorney, Agent, or Firm*—Frishauf, Holtz, Goodman & Woodward

[57] ABSTRACT

To permit web portions (16, 17; 18, 19; 20, 21) slit from longitudinal webs (2a, 2b, 2c) to be selectively interleaved or interlaced, with or without turning over, pairs of turning bars or rods (6, 7; 8, 9; 10, 11; 12, 13) are located in essentially vertically aligned position; laterally of the turning rods, two deflection rollers (22, 23) are positioned which can be individually movably shifted by individual drive motors (32) operating a gear on a rack formed on guide rails, so that the deflection rollers can be selectively positioned at the level of a selected pair of turning rods. This permits placement of a web portion, right side up or turned over, between a pair of web portions which is not necessarily the next adjacent one in the vertical sequence of superimposed webs arriving at the interlacing or interleaving system.

6 Claims, 4 Drawing Sheets

SYSTEM FOR INTERLEAVING AND MIXING A PLURALITY OF WEBS, PARTICULARLY SLIT WEBS RECEIVED FROM A PRINTING MACHINE

FIELD OF THE INVENTION

The present invention relates to accessory apparatus for use with a printing machine, and more particularly to a system for interleaving a plurality of webs, particularly webs which have been slit longitudinally, and received from a rotary web-fed printing machine, for subsequent delivery of the interleaved webs to a folding apparatus, and especially to such an apparatus which is versatile and uses turning bars or rods in which the paths of the webs are simple, so that the apparatus of the system is economical in use of space.

BACKGROUND

German Patent Disclosure Document 35 01 389 describes an apparatus which uses a plurality of turning bars located above each other in a row, and spaced uniformly from each other. Each one of the turning bars has a deflection roller associated therewith. All the deflection rollers are located laterally next to the turning bars. This greatly interferes with accessibility to the turning bars. When two webs have to be handled by this apparatus, the paths of the webs are comparatively long and complex, since spatially separated sets of turning bars or rods are necessary if one web portion is to be introduced between two web portions of a different web.

THE INVENTION

It is an object to simplify an apparatus which permits superimposing and randomly mixing of webs or web portions derived from slitting a web, and which permits introducing any web portion, prime side up, or reversed, that is, turned over, between any two other web portions, and which is simple and permits easy access to operating and/or service personnel.

Briefly, at least three pairs of essentially vertically stacked repositionable turning bars or rods are provided; at least two deflection rollers are positioned laterally, with respect to the turning bars, and associated with two pairs of the deflection rollers. The deflection rollers can be shifted essentially vertically, independently of each other, within the shifting which positions the respective deflection rollers at a vertical level in essential alignment with the respective associated pair of turning bars.

Generally, thus, for n slit webs, each having two parallel web portions, n+1 turning bar pairs are used, in which all the turning bar pairs are located essentially vertically above each other and can be re-positioned along vertical guides.

DRAWINGS

DETAILED DESCRIPTION

Figure 1:
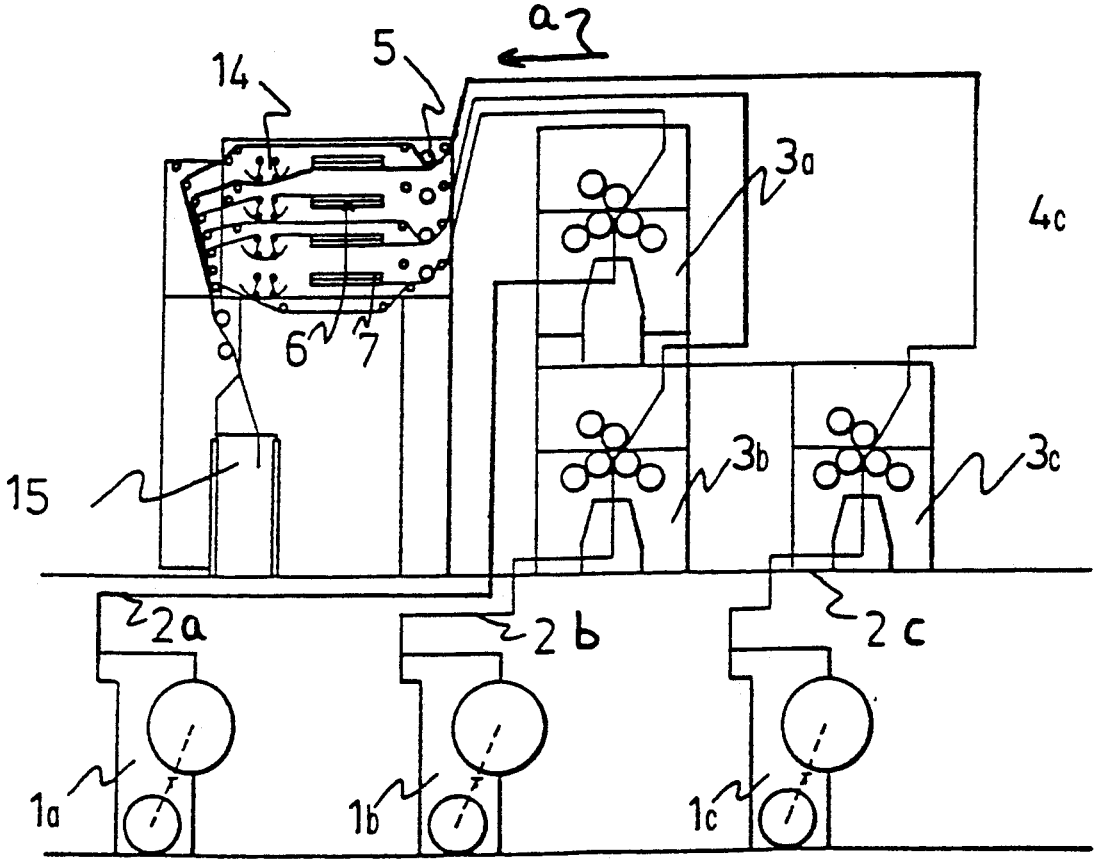
FIG. 1 is a schematic side view of a rotary printing machine system having three printing stations and supplying three webs to a folding apparatus after longitudinally slitting the webs.
Figure 2:
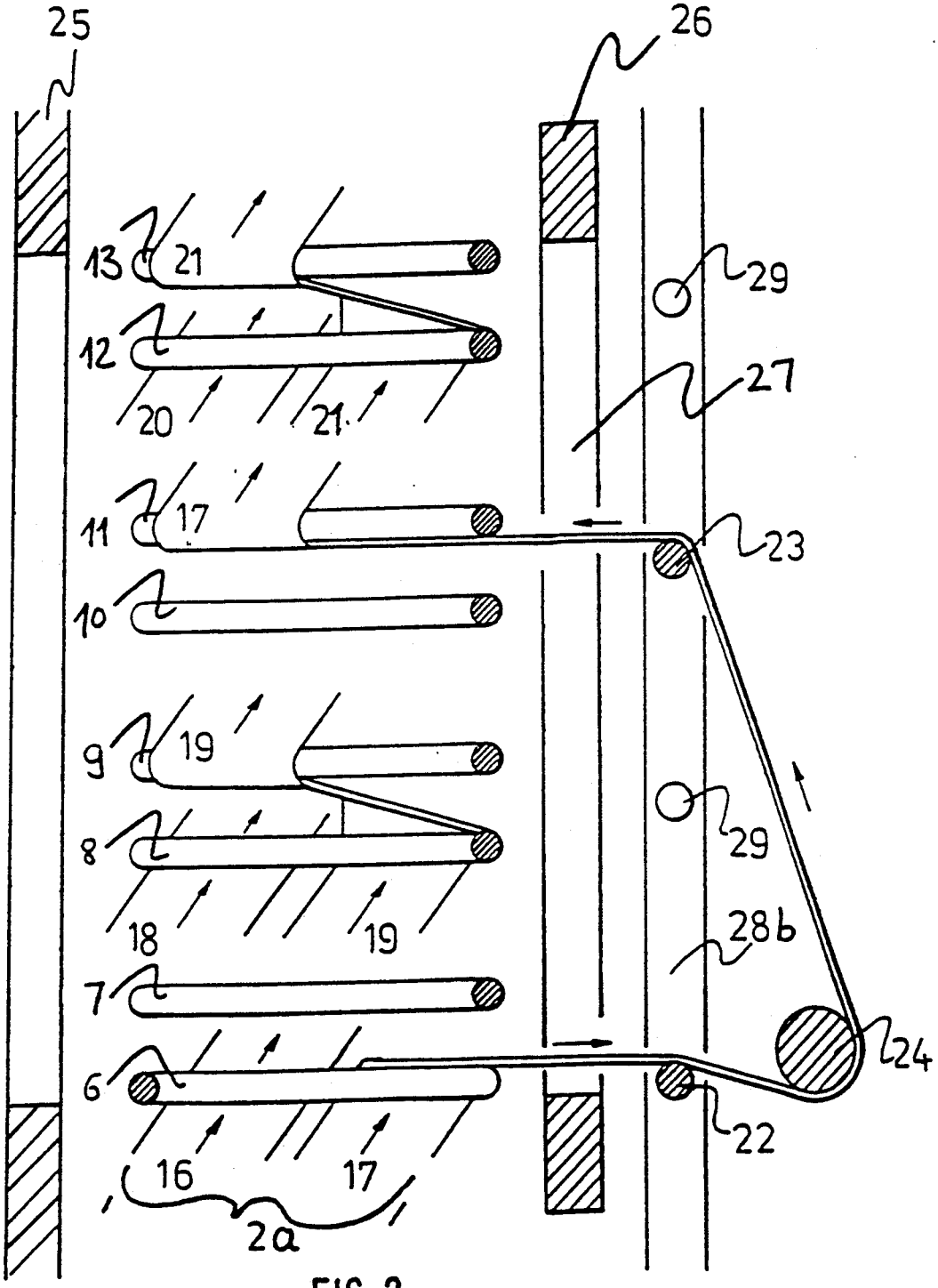
FIG. 2 is a schematic detailed side view of the turning bar and deflection roller system looking in the direction of the path of the webs.

The printing machine system, see FIG. 1, has three web roll changers 1*a*, 1*b*, 1*c*, each supplying a respective web 2*a*, 2*b*, 2*c* to a respective printing machine station 3*a*, 3*b*, 3*c*. The printed webs, of which only web 4*c* is specifically identified, are supplied in the direction of the arrow a to longitudinal slitters 5. One slitter is provided for each one of the webs 2*a*, 2*b*, 2*c*. The slit webs are then fed to four pairs of turning bars or rods 6, 7; 8, 9; 10, 11; 12, 13 (FIG. 2). The webs are then supplied to rocking compensation elements 14, as well known, and then to compensation elements 14, as well known, and then to a folding apparatus 15. The slitter 5 slits each of the webs 2*a*, 2*b*, 2*c* once in longitudinal direction.

Figure 3:
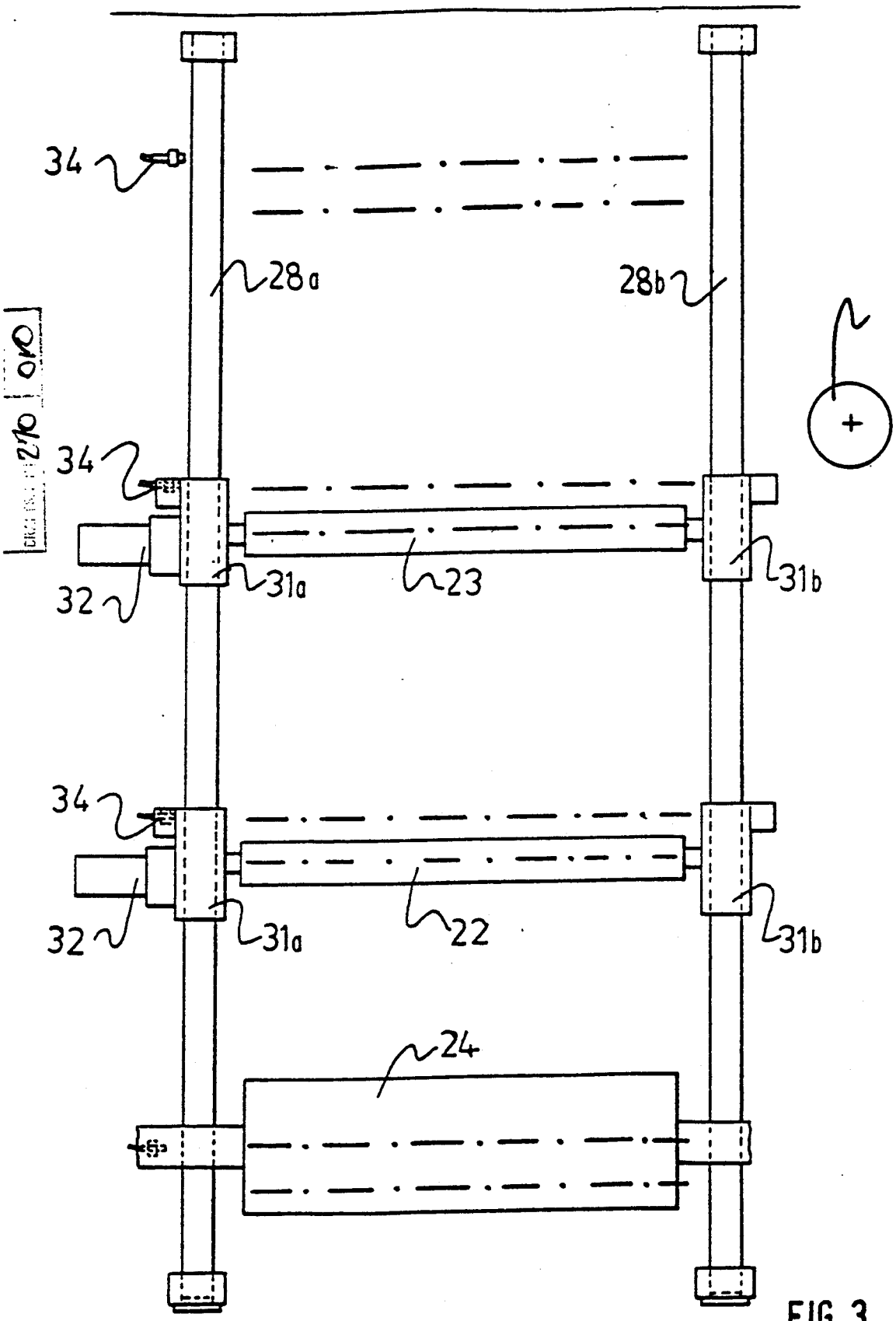
FIG. 3 is a schematic end view of portions of the system of FIG. 2 as seen from the operator side.

FIGS. 2 and 3 illustrate the turning bar system in greater detail. The respective slit webs 16, 17; 18, 19; 20, 21, obtained by slitting the webs 2*a*, 2*b*, 2*c*, are supplied in respective longitudinally arranged planes of the respective pairs of deflection rods 6, 7, 8, 9 and 12, 13. The spacing between the pairs of deflection rods 6–13 is shown expanded in FIG. 2 for better visibility. Each one of the turning bars 6 . . . 13 can be shifted by 90° upon changing the respective turning bars from the operator side 26 of the system. Retaining turning bars so that they can be shifted by 90° is well known and the respective holding, shifting and retention mechanism is not shown since any suitable mechanism used in the industry can be employed.

The space required by the turning bars 6–13 is defined between the wall 25 of the drive side and the wall 26 of the operation side. Both the drive side and the operating side are formed with an access window 27.

Two parallel guide rails 28*a*, 28*b* are located adjacent wall 26 opposite the space in which the turning bars are located. The guide rails 28*a*, 28*b* permit vertically adjustable positioning of two deflection rollers 22, 23. FIG. 2 illustrates at circles 29 possible alternate positions of the deflection rollers 22, 23. The longitudinal axes of the deflection rollers 22, 23 are parallel to the running or supply direction of the webs 2*a*, 2*b*, 2*c*; a driven pulling roller 24 is located adjacent the wall 26 at the side remote from the guide rails 28*a* and 28*b*. It is not vertically movable, and its axis of rotation is fixed. The longitudinal axis of the roller 24 extends parallel to the longitudinal axes of the deflection rollers 22, 23.

Threading, and web paths

The two portions 16, 17 of the web 2*a* are supplied at the bottom side of a plane tangent to the turning rod 6. One web portion 16 is guided, unturned, under the turning rod 6. The other portion 17 is turned by the turning bar 6, which is positioned as an angle turning bar, by 90°, in the direction towards the deflection roller 22, and carried out of the turning bar system through the window 27. The further path of the portion 17 then leads about the deflection roller 22, the driven pulling roller 24, which is provided to compensate for differences in tension of the webs 16, 17, and then about the deflection roller 23 to the bottom side of the turning bar 11. The turning bar 11 functions as a parallel turning bar and brings the web portion 17 above the portion 19. The portion 17 was turned over, so that the prime side which was supplied to the turning bar 6 is now the bottom or verso side.

The webs 18, 19, derived from the web 2b, are also applied tangentially to the bottom of the turning bar 8. The web 18, again, directly and without use of the turning bar, is guided further upwardly. The other web portion 19 is placed over the first web portion 18, without side reversal, by being guided over the two turning bars 8, 9, in which the turning bar 8 is an angular turning bar and the second functions as a parallel turning bar.

The third web 2c is guided over the turning bars 12, 13 in the same manner as has been described with respect to the web 2b. It is guided over the turning bars 12, 13, with the web 21 being turned and directed over the web 20, without side reversal.

All the web portions 16, 17, 18, 19, 20, 21 will now be above each other; they are then guided, individually, over the rocking compensating system 14, to ensure precise further handling and for supply to the folding apparatus 15, subsequent thereto.

The apparatus of FIG. 1 illustrates a simple case in which three webs 2a, 2b, 2c are being handled. More than three webs can be handled by similar apparatus, requiring only a further pair of turning bars for each additional web. In general, n webs, slit longitudinally, require n+1 turning bar rod pairs, located vertically above each other.

The positions of the movable deflection rollers 22, 23 as well as of the pulling roller 24, are shown in FIG. 3; the positions of the turning bars 6–13 are shown merely in schematic outline by chain-dotted lines.

A further deflection roller 30 is provided, positioned approximately at the level of the deflection roller 23, at the right side and outside of the structure, defined by the guide rails 28a, 28b, and located perpendicularly to the deflection rollers 22, 23. The deflection roller 30 can be used to, selectively, interleave the web portion 17 between the other webs without turning it over. The turning bar 11, for this mode of operation, is reset, so that the web 17 leaves the turning bar 11 counter the direction of the arrows shown in FIG. 2. The web 17 is then deflected by the deflection roller 30 by about 180°, so that it leaves the deflection roller again in the run-off direction of the remaining webs. This, then, permits interleaving the web portion 17 with the other web portions 16, 18, 19 without side reversal.

By resetting the position of the deflection roller 23, the web portion 17 can be mixed with the other web portions either over the deflection rod 9, or over the deflection rod 13. In such an operation, the pair of deflection rollers 8, 9 or 12, 13 will not have a web supplied thereto.

The possibility of re-positioning the deflection rollers 22, 23 without a web threaded therethrough permits excellent accessibility to the turning bars 6–13 through the operating window 27, and hence selective placement of interleaved webs, as desired.

The deflection rollers 22, 23 are preferably located in position by a motor drive, so that the positioning of the deflection rollers can be controlled from a remote command console.

Figure 4:
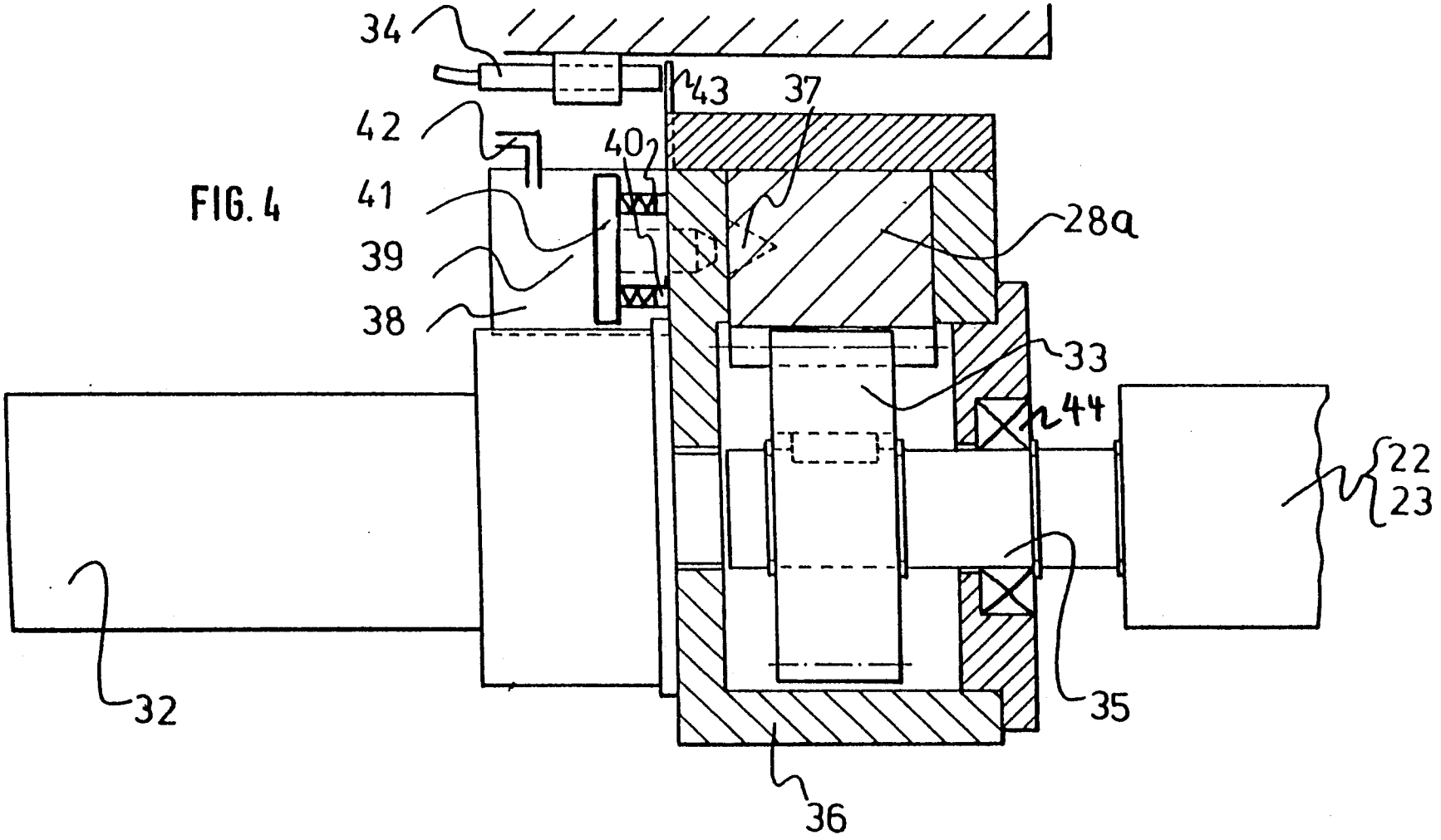
FIG. 4 is a fragmentary part cross-sectional view through a sliding and adjustment system for deflection rollers.

Referring now to FIG. 4:

Slider sleeves 31a, 31b (FIGS. 3, 4) each have a guide housing 36 which surrounds the respective guide rail 28a or 28b at three sides. The fourth side of the guide rail carries a rack, in front of which a rack gear 33 is located, in engagement with the rack. The rack gear 33 is driven by a drive motor 32. The slider sleeves 31a, 31b, respectively, further include a bearing 44 for the shaft 35 of the respective deflection roller 22, 23. The guide rails 28a, 28b are formed with depressions 37, which are essentially pyramid-shaped, and so located that they correspond to adjustment positions for the respective deflection rollers 22, 23. A movable latch 39 cooperates with the depression 37. The latch 39 is connected to a piston element 41, which is guided in a cylinder 38. A reset spring 40 engages one side of the piston 41; the other side of the piston 41 is coupled to a compressed air line 42. The elements 37–42 form a positioning system. The guide housing 32 has a plate 43 secured thereto which is so positioned that it cooperates with a positioning sensor 34. The positioning sensor 34 is constructed in form of a light gate, which provides a control signal when the plate 43 is opposite the sensor 34.

Operation of positioning system

To place the respective deflection roller 22, 23 in a predetermined position, the sensor 34 which is associated with the respective position is energized or activated. The drive motor 32 is energized and rotates the gear 33 which rolls off on the meshing rack 38, thereby moving the respective deflection roller 22, 23 coupled thereto. When the desired position is reached, that is, when the plate 43 is opposite the sensor 34, the sensor 34 will provide a positioning signal. The signal from the sensor 34 causes de-energization, and hence stopping of the drive motor 32 and, simultaneously, application of compressed air through line 42, for example by controlling a suitable control valve, so that the piston 41 will move the latch 39 in the direction of the oppositely located depression 38. The depression 38, with its pyramidal form, provides for positive positioning. This locks the respective deflection roller 22, 23 in position. The inclined surfaces of the depression 37 as well as rounded or similarly inclined surfaces on the latch bolt 39 provide for precise positioning of the respective slider 31a, 31b, and hence of the deflection roller 22, 23, respectively, at both ends of the respective deflection roller.

Various changes and modifications may be made within the scope of the inventive concept.

We claim:

1. System for interlacing or interleaving a plurality of webs, particularly webs received from a printing machine and slid longitudinally into web portions, for subsequent delivery to a folding apparatus (15), said system comprising, in accordance with the invention, at least three pairs of essentially vertically stacked repositionable turning bars or rods (6, 7; 8, 9; 10, 11; 12, 13);

at least two deflection rollers (22, 23) located laterally, with respect to the turning bars; and means (32, 33) coupled to the deflection rollers for individually essentially vertically shifting said deflection rollers within a shifting range which positions the respective deflection rollers (22, 23) at a vertical level in essential alignment with a selected pair (6, 7; 10, 11) of the turning bars to associate each deflection roller with a selected pair of turning bars to provide for selective interlacing or interleaving of web portions being passed over the turning bar prior to delivery to said folding apparatus.

2. The system of claim 1, wherein said shifting means comprises guide rails (28a, 28b) extending essentially vertically laterally with respect to said pairs of turning bars or rods;

and slider means (31*a*, 31*b*) located at axial ends of said deflection rollers, rotatably receiving said deflection rollers, and slidably movable along said guide rails (28*a*, 28*b*).

3. The system of claim 2, wherein said guide rails (28*a*, 28*b*) include rack means;

and said shifting means further includes a drive motor (32) and a gear (33) in meshing engagement with said rack means.

4. The system of claim 2, further including position sensing means (43, 34) associated with predetermined positions within said shifting range;

and locking means (37, 39) respectively locking and unlocking said slider means at the selected predetermined position, as determined by said position sensing means.

5. The system of claim 2, further including a pull roller (24) located at the side of the guide rails (28*a*, 28*b*) remote from the turning rods or bars to compensate tension relationships in webs being passed over the deflection rollers.

6. The system of claim 1, wherein the individual turning bars or rods of said pairs are individually positionable.

* * * * *